US008002085B2

(12) United States Patent
Lacerda et al.

(10) Patent No.: US 8,002,085 B2
(45) Date of Patent: Aug. 23, 2011

(54) WHEEL FLANGE LUBRICATION SYSTEM

(75) Inventors: Mario Lacerda, Tampa, FL (US); Brandon Michael Collins, Kettering, OH (US)

(73) Assignee: Phymet Inc., Springboro, OH (US)

( * ) Notice: Subject to any disclaimer, the term of this patent is extended or adjusted under 35 U.S.C. 154(b) by 887 days.

(21) Appl. No.: 11/169,872

(22) Filed: Jun. 30, 2005

(65) Prior Publication Data

US 2006/0054403 A1 Mar. 16, 2006

Related U.S. Application Data

(60) Provisional application No. 60/585,984, filed on Jul. 7, 2004.

(51) Int. Cl.
*B61K 3/00* (2006.01)

(52) U.S. Cl. ..... 184/3.2; 184/3.1

(58) Field of Classification Search ..... 184/3.1, 184/3.2; 188/264 B

See application file for complete search history.

(56) References Cited

U.S. PATENT DOCUMENTS

| | | | | | |
|---|---|---|---|---|---|
| 2,281,400 | A * | 4/1942 | Welby | ..... | 184/3.2 |
| 4,811,818 | A | 3/1989 | Jamison | | |
| 4,915,195 | A | 4/1990 | Dial | | |
| 5,054,582 | A * | 10/1991 | Aracil | ..... | 184/3.2 |
| 5,085,292 | A * | 2/1992 | Dial | ..... | 184/3.2 |
| 5,251,724 | A | 10/1993 | Szatkowski | | |
| 5,337,860 | A * | 8/1994 | Burke et al. | ..... | 184/3.2 |
| 5,358,072 | A | 10/1994 | Szatkowski | | |
| 6,136,757 | A | 10/2000 | Chiddick | | |
| 6,182,793 | B1 | 2/2001 | Jamison | | |
| 6,619,429 | B1 | 9/2003 | Brand | | |
| 6,854,908 | B2 | 2/2005 | Hui | | |
| 2003/0146051 | A1 * | 8/2003 | Velayutha | ..... | 184/3.1 |
| 2004/0238282 | A1 * | 12/2004 | Mitrovich | ..... | 184/3.2 |
| 2007/0012515 | A1 * | 1/2007 | Murphy | ..... | 184/3.2 |

* cited by examiner

*Primary Examiner* — Bradley T King
*Assistant Examiner* — Thomas Irvin
(74) *Attorney, Agent, or Firm* — Larry A. Fillnow

(57) ABSTRACT

A wheel flange lubrication system for rail vehicles is described consisting of a rigid lubrication block, which is forced against a wheel flange to provide lubrication to the wheel flange. The block or stick is maintained in position to reduce flange wear, to minimize the movement of lubricant to undesirable locations, such as the crown of the rails and the tread of the wheel, and to provide a lubrication system which is environmentally safe. Preferably the lubrication block is arc shaped and spring-forced laterally and radially into the flange. The lubrication system is designed to stay in contact with the wheel flange and apply the desired amount of lubrication in the flange area using the side contact surface of the block. This adjustable position control is provided by applying independent forces which are directed radially towards the crotch of the wheel and laterally towards the wheel flange. The lubrication system is applicable to single or two flange wheels.

12 Claims, 7 Drawing Sheets

WHEEL FLANGE LUBRICATION SYSTEM

RELATED APPLICATION

This patent application is based on and claims priority of provisional patent application No. 60/585,984, filed on Jul. 7, 2004.

TECHNICAL FIELD

The present invention relates in general to systems for lubricating wheel flanges on railroad vehicles, overhead cranes, trolleys and other equipment traveling on rails. In particular, the system relates to lubrication of wheel flanges using a rigid lubricant block or stick.

BACKGROUND OF THE INVENTION

Friction between rails and wheels is known to increase the wear on the wheel flange and increase fuel consumption. It has long been known to apply lubricant to a wheel flange to reduce the friction and wear between a vehicle wheel and a rail. Lubricants which are not solid (greases and liquids) have many disadvantages including; storing and refilling the lubricant container, controlling the amount applied and dealing with environmental concerns with lubricant on the track. Most of these systems also rely on the lubricant rubbing from the wheel flange onto the rail and carrying back to subsequent cars. The amount of lubricant being shared with subsequent wheel flanges is not easily controlled.

It is well known that misalignment will occur between the rail and wheel flange due to the vertical and horizontal movements of the wheel. Rail alignment will also contribute to wheel flange wear. Since there will always be alignment problems, it is important that the wheel flange lubrication system can track the position of the wheel flange relative to the rail to maintain constant contact of the lubricant with the flange.

The use of a lubricant block or stick has eliminated some of these problems but still has not been completely successful. Lubricant sticks are usually rigid blocks of lubricant which gradually wear with contact and must be replaced over time. The sticks must be held against the flange to maintain contact and this is usually accomplished with springs. It has been difficult to mount these devices on board a rail vehicle or crane and control where the lubricant stick is positioned to insure the lubrication is applied to the flange. Previous sticks have had their tips pushed against the wheel flange and have not had their position controlled to compensate for the normal wheel movement and curvature of the track. The tip of the lubricating stick is used to contact the wheel flange. The capability to adjust the forces and direction on the stick has been lacking.

The rail and crane industries are still in need of a flange lubrication system which applies lubricant in the desired amount and location while also being easily mounted to the vehicle. Applying lubricant to a wheel flange which is subject to a great range of movement has created a need not solved by previous lubricant stick or block application systems.

SUMMARY OF THE INVENTION

A rigid block of lubricant is provided with a holder for directing a contact side of the block against the wheel flange. A method and means are provided to force the contact side of the lubricant block laterally against the wheel flange and radially into the crotch of the wheel. The rigid block has independent radial and lateral force means for improved control of the position of the block. A significant improvement in lubrication control is achieved by providing means to adjust the forces used to position and direct the lubrication block. Improved control minimizes lubricant contact on the tread of the wheel or on the rail. A preferred design is the use of a curved block or segment blocks to provide an arc length of at least 5 degrees relative to the wheel radius.

The lubrication system of the present invention includes a lubrication block or block segments supported by a spine which holds the lubricant block around the wheel. The spine provides a radial flexing action to provide force towards the crotch of the wheel. The spine will be connected to metallic holders which are used to attach side springs for lateral force. The tensioning means keep the lubricant block in direct contact with the wheel flange to distribute lubricant to the wheel flange. The spine(s) and metallic holders are normally held in place while the lubricant material is cast, extruded, injection molded, etc., around them.

Support means are included to keep the lubrication system in position for proper lubrication and to compensate for vertical and horizontal movement of the wheels relative to the rails.

The present invention is applicable to a wheel lubrication system for a wheel with two flanges where two lubrication blocks (or two connected segments of blocks) are mounted with side springs to push the blocks against the two wheel flanges or on a single wheel flange design where only one lubrication block (or one connected segments of blocks) is forced against the one wheel flange.

DETAILED DESCRIPTION OF THE INVENTION

Figure 1:
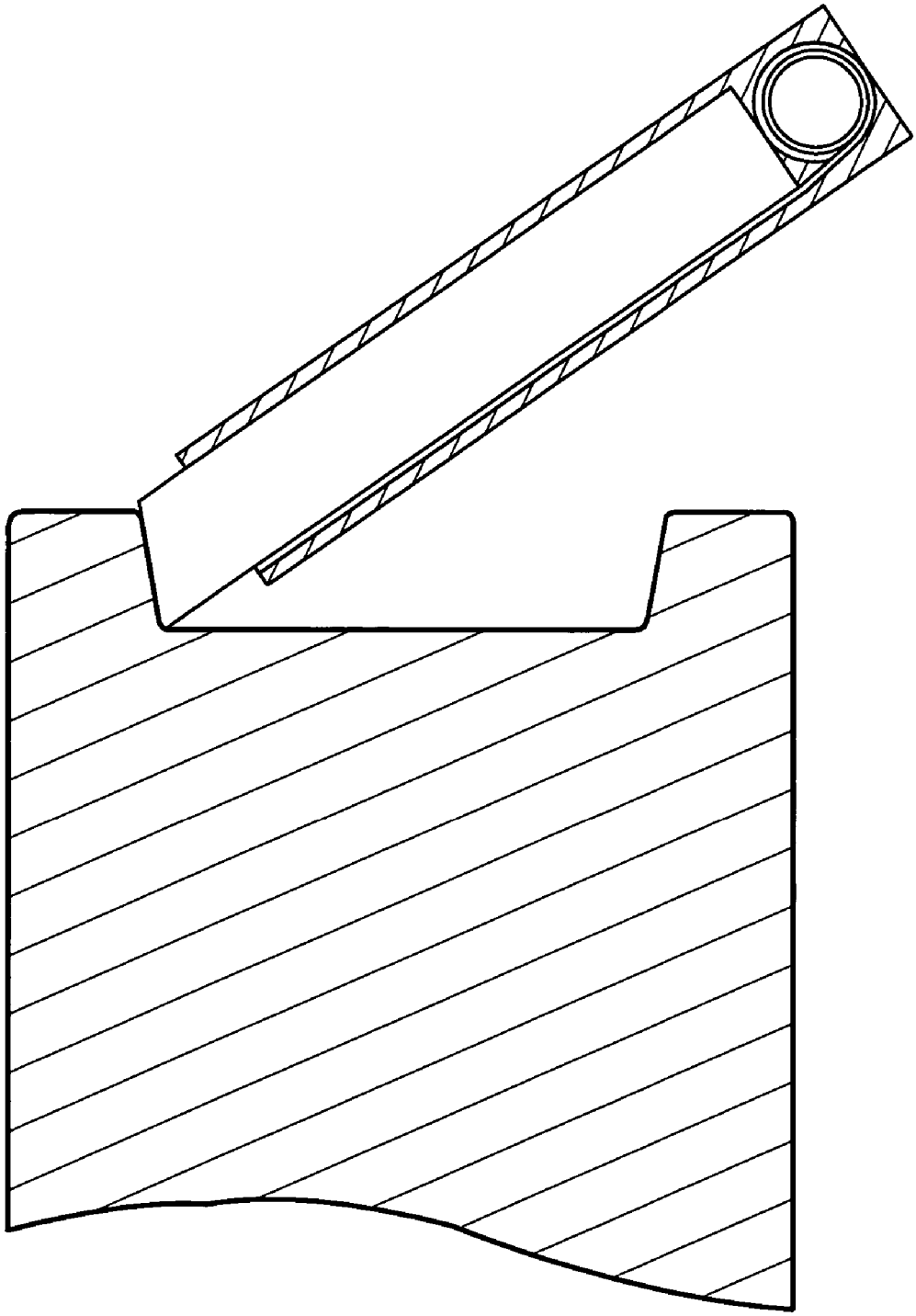
FIG. 1 Prior Art
FIG. 1 is a vertical sectional view of a lubricant system of the prior art.

The following description is a preferred embodiment by way of example only and without any limitation to the combination of features for carrying out the invention.

The present invention relates to a system for lubricating wheel flanges using a rigid lubrication block. Various lubricants may be used including microporous polymeric lubricants, graphite, molybdenum disulfide, impregnated polymers, solid grease, sponge, sintered bronze, impregnated felt, PTFE (PolyTetraFluoroEthylene) and UHMWPE (UltraHighMolecularWeightPolyEthylene). Other lubricants may also be used. A preferred lubricant is the microporous polymeric lubricant which has excellent wear characteristics and provides a controlled release of the lubricant from the block. This type of material is taught in U.S. Pat. Nos. 3,541,011; 3,547,819; and 3,729,415.

The lubricant block or stick is composed of at least 30% solids. The lubricant block may have various shapes. The shape, amount of surface contact, type of lubricant, force, surface characteristics of the flange, etc., determine the amount of lubricant being provided to the flange. A major improvement provided by the invention is the increased surface area provided by the contact surface of the arc shaped lubricant block contrasted to the tips of previously mentioned sticks. By providing an arc shape, the lubricant blocks provide a contact surface of at least 5 degrees of arc and preferably at least about 10 degrees up to the point where the blocks do not cause interference between the wheel and rail. The contact surface of the lubricant block may be a single surface or composed of segments which are connected or spaced apart. A typical lubricant block would be an arc shape of about 45-315 degrees and preferably about 90-135 degrees relative to the wheel. An arc shape of greater than about 315 degrees would not provide much improved lubrication and would begin to cause difficulties with the installation.

Mounting means must be provided in order to support the lubricant block in position. Any mounting means may be used which provides a stable support which maintains the block in the desired position regardless of distance between the wheel flange and the rail. The mounting means provide a way of increasing the contact surface area with the wheel flange and means to adjust the forces. The mounting means also provide the desired force vectors for directing the lubricant block into the flange. The force is preferably provided by springs which provide radial and lateral forces which maintain the desired position and compensates for variations in distance between the rail and wheel flange.

The lubricant blocks, including the mounting means, must also be supported by means which attach the lubricating system to the vehicle. Various bracket designs have been taught in the past. It is important that the lubricating system be kept stationary relative to the wheel. The brackets or support means used in the present invention are not novel in and of themselves and numerous designs may be used.

The lubrication system of the present invention has solved the problems with previous designs by providing lubrication blocks which have adjustable radial and lateral forces to ensure the blocks are maintained in a position which lubricates only the wheel flange. The amount of surface contact area provided by the controllable positioning of the high surface area arc shaped lubrication blocks provides a method of controlling the amount of lubricant supplied to the wheel flange. The invention will now be discussed in more detail and in reference to the figures.

FIG. 1 shows a prior art lubricator where a stick is spring fed into position. The pressure is applied to the back end of the stick and the lubricant is applied from the front end of the stick. This approach does not allow the end of the lubricant stick to remain in contact with the wheel flange during normal wheel movement since there are no independent radial and lateral forces.

Figure 2:
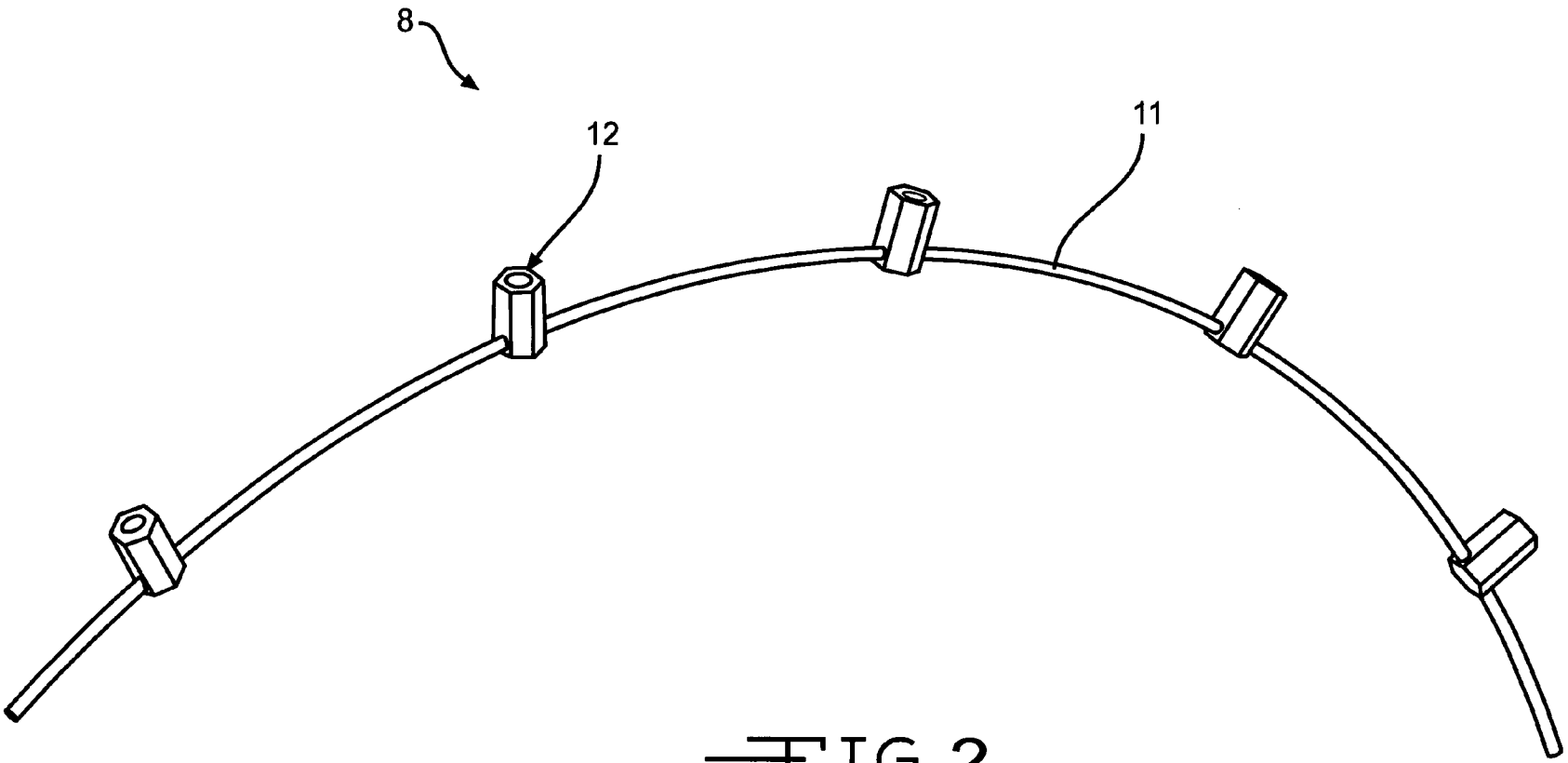
FIG. 2 is a perspective view of the invention of the spine support for the rigid lubricant block of the invention showing the wire springs and side spring holders.

The lubrication support system 8 of the present invention for casting, injecting, molding or extruding lubricant blocks 23 (shown in FIG. 3) includes a wire 11 of any cross section shape formed into a circular arc fed through holders 12 are shown in FIG. 2. Although the preferred lubrication support system 8 utilizes a circular arc wire support for the lubricant, an external support, such as, a circular arc shaped C-channel, U-channel and angle bracket, could be used as an alternative support system while providing the same functional characteristics. Any number of holders 12 may be used depending on the length of the lubricant blocks 23. The desired thickness of the lubricant blocks 23 will also determine if multiple wires 11 are threaded through the holders 12 which may have openings at various locations for multiple wires. Bolts 13 are used to secure the springs 14 to the holders 12. Springs 14 supply lateral force to the lubricant blocks 23 as shown in FIG. 4. Mounting brackets 15 are used to support the lubrication support system 8 attached by retaining bolts 16 in addition to the tensioning rod 18. It is important to note that the thickness of the rigid lubricant blocks 23 and the lubrication support system 8 (wire diameter, number of wires and wire composition) will be selected for providing the desired rigidity. The size of the rigid blocks 23 must allow space for the springs which minimizes the contact side 23*a* of the lubricating blocks 23 with the tread areas 10 of the wheel 9, as well as, the rail 40. Although springs 14 may be the preferred method of supplying lateral and radial forces, other methods, such as, metal clips, air; gas or hydraulic actuated cylinders via pumps, compressors and/or motor driven servo devices are also capable of producing said forces.

One or more tensioning devices 17 may be used to provide radial force and adjust the amount of contact between the lubricant blocks 23 and the wheel flange 24 shown in subsequent figures. The tensioning devices 17 may include one or more rods 18 having loops 18*a* for attaching to the mounting brackets 15. The use of more than one rod 18 will provide an added measure of safety. The tension adjustment bolts 19 are positioned in the loops 18*a* and connected by upper and lower tensioning nuts 20 and 21. Bracket nuts 22 are used to connect the tensioning device to the mounting brackets 15. Washers may also be included. The amount of tightening on the upper and lower tensioning nuts 20 and 21 will position the rod 18 and thus the lubricant blocks 23 correctly. As will be explained in more detail later, this influences the amount of the contact side 23*a* of the blocks 23 in contact with the wheel flange and the amount of lubricant and its distribution.

Figure 3:
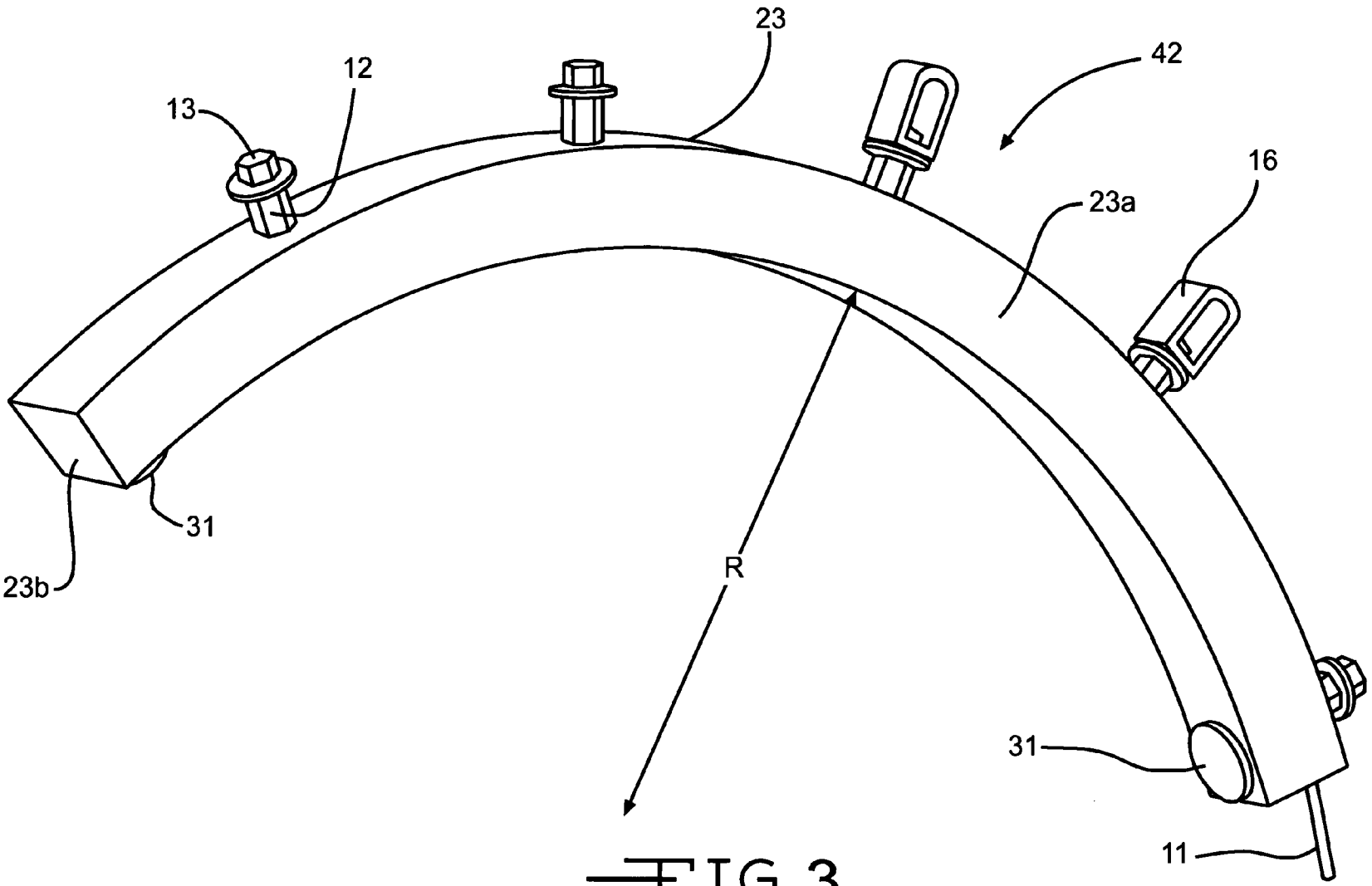
FIG. 3 is a perspective view of the invention of the spine support showing the lubricant block around the spine.
Figure 4:
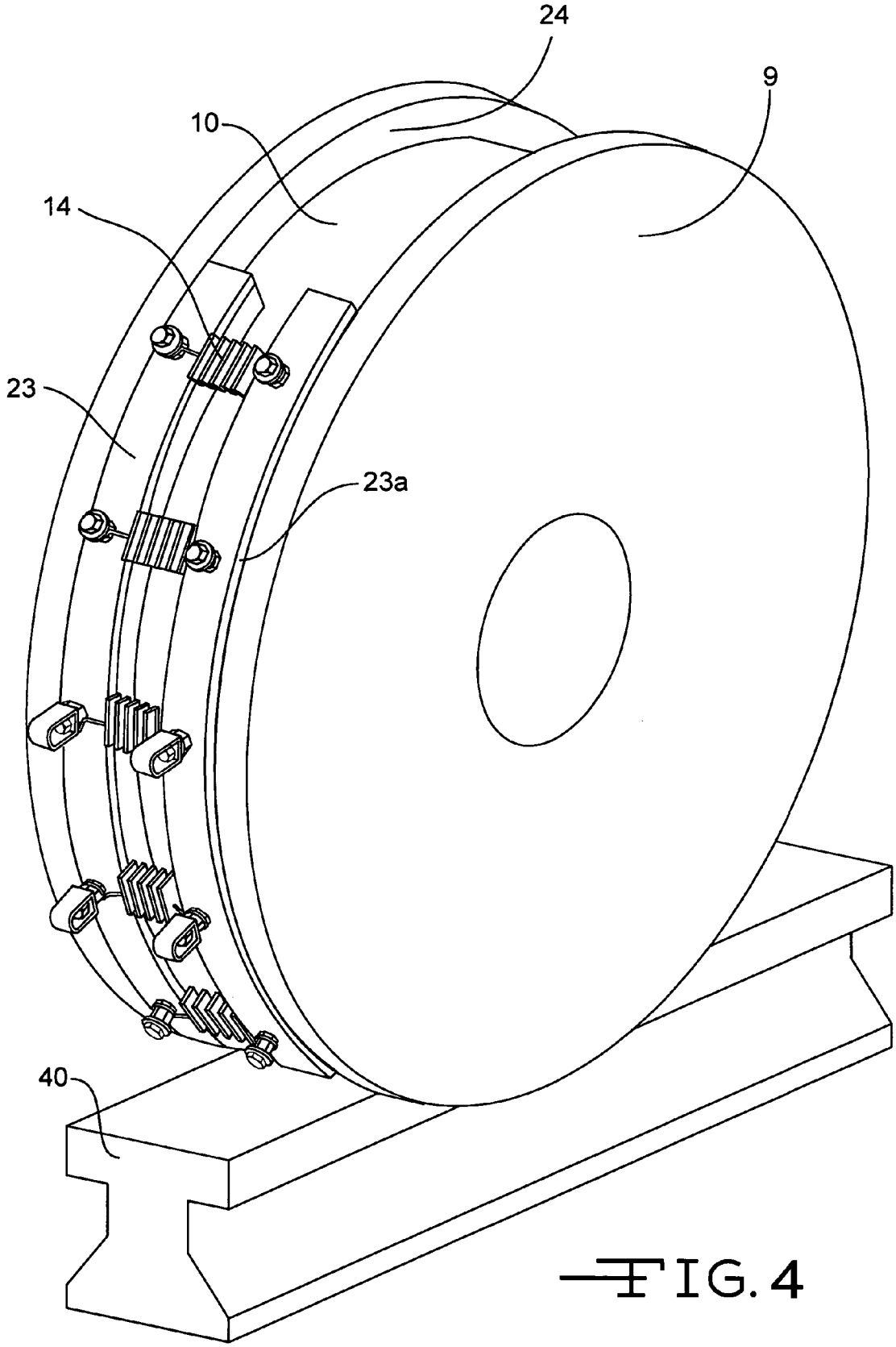
FIG. 4 is a perspective view of the invention of a pair of lubricant blocks with side springs mounted within on a wheel.
Figure 5:
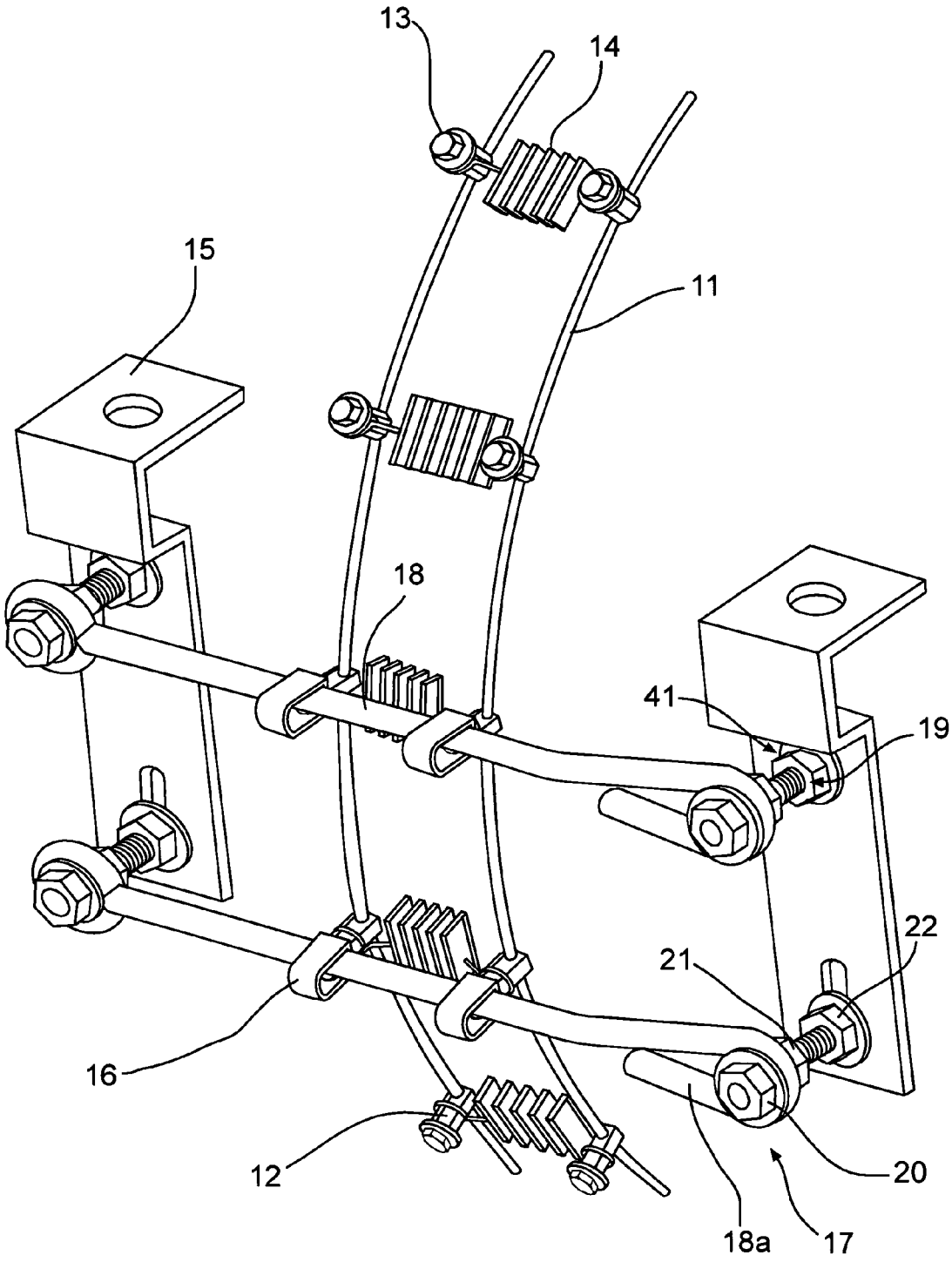
FIG. 5 is a perspective view of the mounting brackets and holders for the lubricant blocks of the invention.
Figure 6:
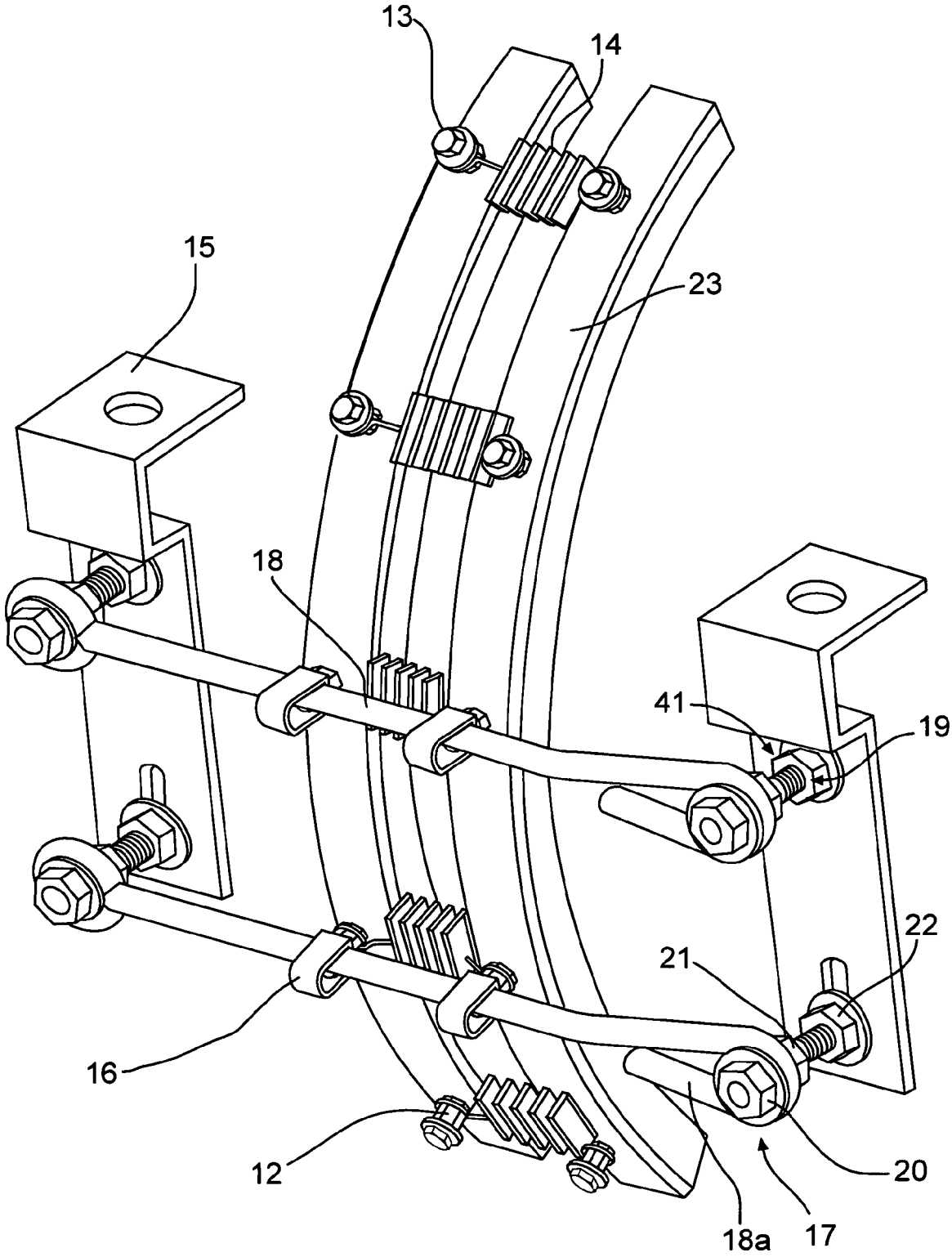
FIG. 6 is a perspective view of the invention of the mounting brackets and holders connected to the lubricant blocks.

FIG. 3 is basically the same as FIG. 2 except the lubricant block 23 is shown with the lubrication support system 8 which includes the circular arc wire 11 and holders 12. It is important to understand that the amount of tightening of the upper and lower tension nuts 20 and 21 controls the contact side 23*a* of the lubricant block 23. This insures the lubricant being applied to the tread of the wheel is minimized and the wheel flange 24 is lubricated with the desired control. The importance of arc shaped block 23 (or segments of blocks which are connected) will now become clearer. This allows the bending of the arc at the lubricant block tips for a contact side 23*a* length which is easily adjusted for control of the amount of lubricant and location of the lubricant on the wheel flange 24. The radius r of the lubrication block assembly 42 shown in FIG. 3 should approach the radius of the wheel tread 10, such that the contact area of the rigid lubrication blocks 23 to the wheel flange 24 is maximized. The radius r of lubrication block assembly can be increased to conform to the radius of the wheel tread 10, if less than optimum, by adjusting nuts 20, and thereby, positioning rod 18 to apply a radial force to increase the lubrication block assembly radius. The length of the arc shaped lubricant block 23, or segments, should be at least about 5 degrees, preferably at least about 10 degrees, and more preferably, about 90 to 135 degrees relative to the wheel radius. Longer lengths of the lubricant block 23 in the shape of an arc will provide more lubrication surface area but are also limited to a length which permits easy installation. As stated previously, it is important to understand that the amount of lubricant must also be controlled to avoid lubrication on the tread of the wheel and on the rail 40.

The present invention is not limited to a single block of rigid lubricant 23. If segments of lubricant blocks 23 are employed, one must include connection means with springs between the segments (not shown). This is important for installation purposes and control of the surface area of contact. It is the sum of the arc shaped segments which compares with the arc length of a single block 23 in order to provide the same levels of lubrication and control of the lubricant distribution. Numerous forms of rigid lubricant blocks may be used. Those skilled in the art will appreciate that different materials will require different lengths of surface contact to provide the same amount of lubrication.

It is a further feature of the present invention that solid, wear resistant spacers 31 in FIG. 3 may be used to improve the spacing control of the arc shaped lubricant blocks 23 above the wheel tread 10. Considerable radial forces may be applied and still a gap is provided between the lubricant blocks 23 and the tread. This will also prevent the lubricant from depositing onto the wheel tread 10 thus allowing adequate braking of the rail vehicle or crane Altering the geometry of the cross section of the lubricant, such as, adding features like a relief angle between the lubricant and the tread will further increase control of the amount of lubricant deposited on the tread. The use of a microporous polymer for the lubricant block 23 has several advantages. This material has a controlled release of the lubricant from within the rigid lubricant block. The rigidity of the block is maintained to provide improved service life. The lubrication block 23 provides a supply of lubricant that is available over a considerable time period and reduces the rate at which lubrication blocks 23 need to be replaced. The present invention has provided over 8 months of continuous lubrication on a 2-flange wheel application with a single microporous block of lubricant produced by PhyMet, Inc. under the trade name, MicroPoly®. The amount of wheel flange 24 wear has been drastically reduced using the rigid block of lubricant 23 with adjustable radial and lateral forces for improved lubricant control. See Tables 1 and 2 below.

TABLE 1

Wear rate and life of 24" (610 mm) diameter double flange crane wheel

| Lubrication | Wear rate (mm/week) | Crane wheel life (weeks) |
|---|---|---|
| None | 0.9 | 24 |
| Stick lubricator with MicroPoly ® | 0.3 | 76 |
| Present Invention with MicroPoly ® | 0.2 | 108 |

TABLE 2

Wheel life of a 27" (686 mm) diameter double flange crane wheel

| Lubrication | Wear rate (mm/week) | Crane wheel life (weeks) |
|---|---|---|
| None | 0.45 | 52 |
| Present Invention with MicroPoly ® | 0.10 | >156 |

It is preferable that the height of the lubricant blocks 23 should be at least the height of the wheel flange 24. The amount of lubricant provided will depend on the height and length of the lubricant blocks 23.

Figure 7:
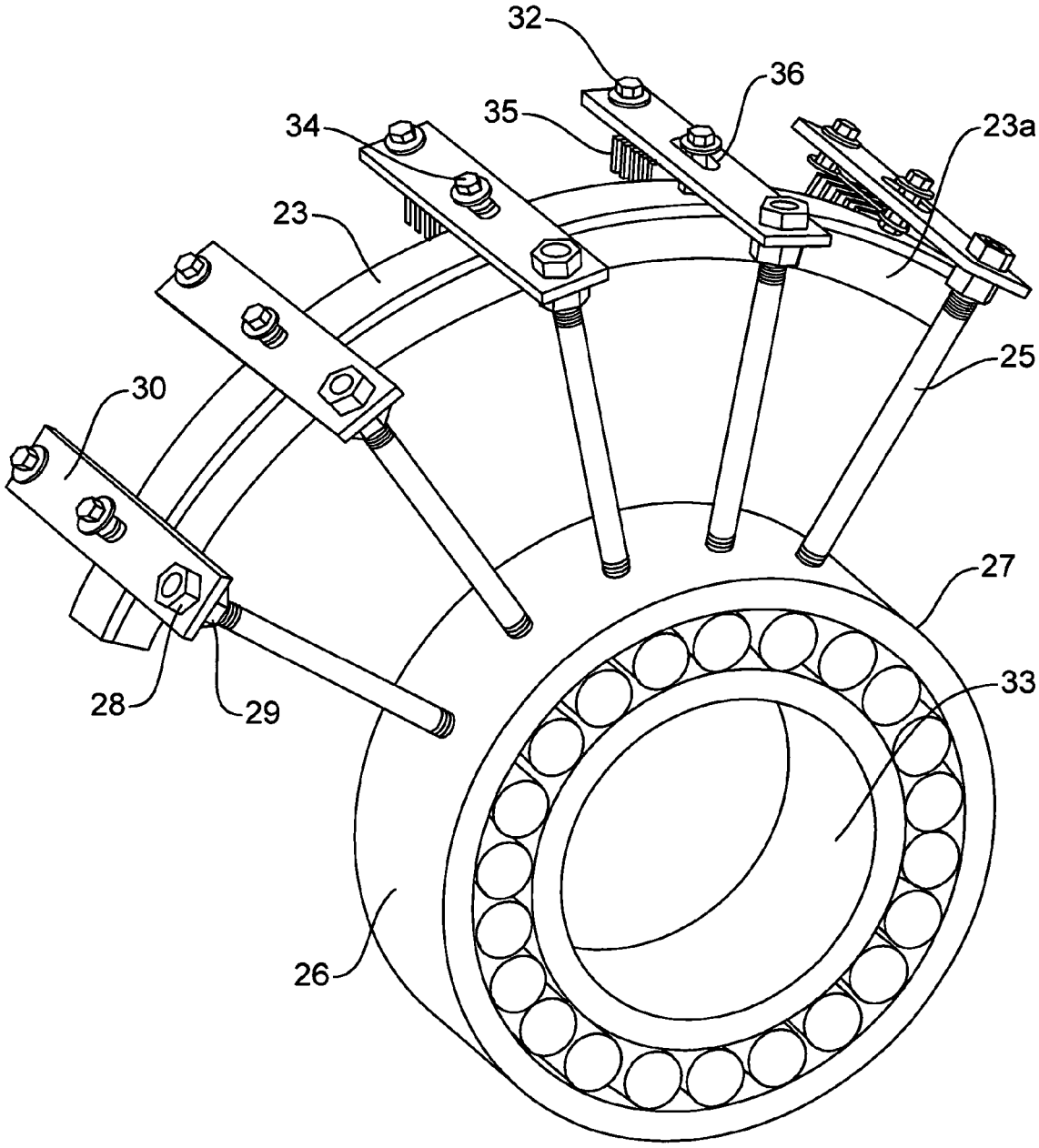
FIG. 7 is a perspective view of the invention showing the mounting system for a single wheel flange lubrication system.

The present invention may also be applied to single flange applications. As shown in FIG. 7, it is not possible to provide the lateral force from springs 35 which push in both directions as in the two flange designs. In order to provide the lateral force, a different support system is required. One way of providing this support is with the use of multiple rod design wherein rods 25 are connected to an outer race 26 of a bearing 27 that does not rotate as the inner race of the bearing 33 rotates with wheel. The rods 25 are threaded and fasten to nuts, 28 and 29 which fix the rods 25 to brackets 30 which are connected to spring anchor bolts 32 which allow the springs 35 to push against the lubrication block 23, thereby, forcing the contact side 23*a* of the lubrication block 23, against the wheel flange 24, not shown, held in proper alignment by alignment bolts 34 and bracket slot 36. This modification, which may be done in other manners, provides a rigid lubrication block 23 which pushes the contact side 23*a* laterally and radially without the use of springs 14 acting in opposed directions.

The invention has significant advantages. The lubrication system may be easily produced and has great flexibility in application to a wide range of operating conditions. It is easily applied to all wheel flange designs. The wheel flanges are lubricated with a control not previously obtainable. The system is easily installed and avoids the maintenance concerns of other systems. There are also no environmental issues with the present invention. While the present invention has been shown in several embodiments, it should be apparent to those skilled in the art that it is not so limited and numerous changes may be made without departing from the scope of the invention.

We claim:

1. A method for lubricating a flange of a wheel supporting a body riding on a rail, the method comprising the steps of:

a) providing a rigid lubricant block having:
   1) an arc shape;
   2) a spine extending through said block; and
   3) holders having openings with said spine fed therethrough;

b) providing support via a mounting bracket to maintain said block stationary relative to said wheel flange;

c) providing lateral force to force said block against said wheel flange, said force being secured to said holders;

d) providing radial force on said lubricant block via a positioning rod to position said lubricant block into a crotch of said wheel flange, said force being independent of said lateral force; and e) adjusting an arc contact length of said block by bending said lubricant block arc via a tensioning device to control said wheel flange lubrication.

2. The method of claim 1, wherein said lubricant block is selected from the group of a microporous polymeric lubricant, graphite, impregnated polymers, solid grease, sponge, sintered bronze, impregnated felt, PTFE and/or UHMWPE.

3. The method of claim 1, wherein said lubricant block arc contact length is about 45 to about 315 degrees relative to said flange.

4. The method of claim 1, wherein said lateral force includes springs which hold said lubricant block in contact with said flange.

5. The method of claim 1, wherein said rigid block is selected from the group of injected, molded, extruded, and cast rigid lubricants.

6. The method of claim 1, wherein said spine is attached to a set of springs for forcing said arc contact length of said block against said flange.

7. An apparatus for lubricating a flange of a wheel supporting a body riding on a rail, the apparatus comprising:

a) a rigid lubricant block having:
   1) an arc shape;
   2) a spine extending through said block; and
   3) holders having openings with said spine fed therethrough;

b) a mounting bracket supporting said block stationary relative to said wheel flange;

c) a lateral force means selected from the group of springs; metal clips; cylinders via pumps; compressors and/or motor driven servo devices selected from the group of air, gas and hydraulic actuated; to laterally force said block against said wheel flange, said force means being secured to said holders;

d) a positioning rod radially forcing said lubricant block into a crotch of said wheel flange, said radial force being independent of said lateral force; and e) a tensioning device having at least one rod, tension adjustment bolts, and tension adjusting nuts, to adjust an arc contact length of said lubricant block by bending said lubricant block arc to control said flange lubrication.

8. The apparatus for lubricating a flange of a wheel of claim 7, wherein said lubricant block has an arc contact surface length of at least about 45 to about 315 degrees relative to said wheel flange.

9. The apparatus for lubricating a flange of a wheel of claim 7, wherein said lubricant block support means is selected from the group of a circular arc wire support, a circular arc shaped C-channel, a U-channel and an angle bracket.

10. The wheel flange lubrication system of claim 7, wherein said spine is attached to a set of springs for forcing said arc contact length against said flange.

11. The wheel flange lubrication system of claim 7, wherein bracket nuts are used to connect said positioning rod to said tensioning device.

12. A method for lubricating a flange of a wheel supporting a body riding on a rail, the method comprising the steps of:

a) providing a rigid lubricant block having:
   1) an arc shape;
   2) a spine extending through said block; and
   3) holders having openings with said spine fed therethrough;

b) providing support via multiple threaded rods to maintain said block stationary relative to said wheel flange;

c) providing lateral force to press said block against said wheel flange, said force being secured to said holders and comprising:
   1) supporting said lateral force with said rods;
   2) attaching said rods to a lateral spring bracket by nuts;
   3) connecting said spring brackets to spring anchor bolts;
   4) pushing said lubrication block in a single direction against said wheel flange with springs;
   5) connecting said rods to an outer race of a bearing, said outer race rotating independently of said wheel; and
   6) providing an inner bearing race which rotates with said wheel;

d) providing radial force on said lubricant block via said rods to position said lubricant block into a crotch of said wheel flange; and e) adjusting an arc contact length of said block by bending said lubricant block arc via said nuts to control said wheel flange lubrication.

* * * * *